US005586961A

United States Patent [19]

Quint

[11] Patent Number: 5,586,961

[45] Date of Patent: Dec. 24, 1996

[54] AQUATIC EXERCISE EQUIPMENT

[76] Inventor: Jeffrey T. Quint, 6641 Smith Rd., Cincinnati, Ohio 45140

[21] Appl. No.: 365,209

[22] Filed: Dec. 28, 1994

Related U.S. Application Data

[63] Continuation-in-part of Ser. No. 189,072, Jan. 28, 1994, Pat. No. 5,378,213.

[51] Int. Cl.[6] ..... A63B 21/008

[52] U.S. Cl. ..... 482/111; 482/70; 482/62; 482/73; 482/138

[58] Field of Search ..... 482/111, 54, 138, 482/137, 139, 55, 72, 73, 70, 57, 62

[56] References Cited

U.S. PATENT DOCUMENTS 4,869,493 9/1989 Johnston ..... 482/54
5,098,085 3/1992 Abboudi et al. ..... 482/70
5,123,641 6/1992 Abboudi et al. ..... 482/111
5,226,866 7/1993 Engel et al. ..... 482/54
5,378,213 1/1995 Quint ..... 482/54

*Primary Examiner*—Lynne A. Reichard
*Attorney, Agent, or Firm*—Wood, Herron & Evans, P.L.L.

[57] ABSTRACT

A universal aquatic exercise machine that includes a plurality of exercise devices, for example, a first exercise device rotatably mounted on a base that moves through a rotary path of motion, a second exercise device rotatably connected to the base that moves back and forth in a reciprocating motion and a third exercise device mounted on the base for reciprocating back and forth motion. The aquatic exercise machine includes a pivoting seat that permits the exercise devices to be performed in either a seated or an erect posture. The exercise devices may have fixed area resistance elements or variable area resistance elements. In addition, underwater footwear facilitates submerged leg exercises and activities such as sliding, skating and other activities.

50 Claims, 5 Drawing Sheets

AQUATIC EXERCISE EQUIPMENT

This application is a continuation-in-part of U.S. patent application Ser. No. 08/189,072 filed on Jan. 28, 1994 and issued on Jan. 3, 1995 as U.S. Pat. No. 5,378,213 for "Aquatic Treadmill with Mesh Belt".

BACKGROUND OF THE INVENTION

1. Field of the Invention

The invention relates to exercise devices, and more particularly, to exercise devices submerged in a liquid and utilizing the resistance of the liquid.

2. Description of the Related Art

Aquatic exercise devices in which the user utilizes the resistance forces of a liquid such as water are well known. Aquatic exercising is becoming more favored because the forces generated during the exercises are generally uniform and are of the nonimpact type. Further, water therapies are favored where the user has strength or balance limitations, or, is particularly fragile, or, has a condition where the warmth of the water is also therapeutic.

Aquatic treadmills are well known, for example, as disclosed in U.S. Pat. No. 5,378,213. Further, aquatic exercise devices that exercise the arms or legs in a rotating cycle-type motion are also known, such as that disclosed in U.S. Pat. No. 4,087,877. Another aquatic exercise device is disclosed in U.S. Pat. No. 4,759,544 in which the legs of a user are moved against a water resistance in a generally reciprocating motion. Further, U.S. Pat. No. 5,098,085 discloses an aquatic exercise machine in which the arms of a user are exercised in a generally reciprocating motion against a water resistance with the user either standing or seated.

While the above and other known aquatic exercise devices and machines operate satisfactorily, generally, each device or machine is designed as a stand-alone unit to provide only a single exercise for the user. However, with most exercise programs, it is desirable that different muscle groups are exercised; and further, that the strengths of the various muscle groups be maintained in a preferred proportional balance. Therefore, a comprehensive exercise program requires several different exercises. However, given that the known aquatic exercise devices and machines are limited to one or a few closely related exercises, several different devices and machines will be required for a more comprehensive exercise program. The necessity of having to use several different independent devices and machines has the disadvantage of also requiring a correspondingly larger water tank in which to locate those various pieces of equipment. Alternatively, with a smaller water tank, the various pieces of equipment must be placed into and removed from the tank with a crane and stored when not in use.

SUMMARY OF THE INVENTION

To overcome the disadvantage described above and to provide aquatic exercise capabilities that were here-to-fore not known and unavailable, the present invention provides an aquatic universal exercise machine. The aquatic universal exercise machine of the present invention has numerous pieces of aquatic exercise equipment operably connected to a single base or frame. The aquatic universal exercise machine of the present invention permits a user with a single piece of equipment to exercise all their limbs in rotary or reciprocating motions whether in seated, standing or recumbent postures. The aquatic universal exercise machine of the present invention is highly modular and various pieces of exercise equipment may be easily added to or removed from the base or frame. The aquatic universal exercise machine of the present invention has a relatively small footprint, and many different exercises may be performed in a relatively small tank of water. The aquatic universal exercise machine of the present invention is especially useful in those situations where a comprehensive aquatic exercise program is desired, but it is desired to minimize the size of the water tank or it is necessary to reduce the allocation of space in a water tank to the exercise equipment.

According to the principles of the present invention and in accordance with the described embodiments, the universal aquatic exercise machine includes at least two exercise devices submerged in a liquid such as water and connected to a common frame. In one embodiment, the exercise devices include an erect posture exercising device such as a treadmill or skis in combination with oars having a fluid resistance element located below the oar pivot point. In alternative embodiments, the erect posture exercising device such as a treadmill or skis is combined with a second exercise device providing either, a rotary, or, a reciprocating motion against the water resistance. In a further embodiment, the two exercise devices of the universal aquatic exercise machine includes a first exercise device moving through a rotary path of motion in the water and a second exercise device moving in a back and forth reciprocating motion in the water. In further alternative embodiments, the two exercise devices of the universal aquatic exercise machine include either, the rotary motion or, the reciprocating, exercise devices in combination with oars having the fluid resistance element located below the oar pivot point. In a further aspect of the invention, the universal aquatic exercise machine includes three independent aquatic exercise devices submerged in the water and mounted on a common frame. The above embodiments of the invention have the advantage of permitting a comprehensive multi-exercise program with a compact and relatively small exercise machine.

The universal aquatic exercise machine includes a seat which is pivotally mounted on the common frame and selectively movable between horizontal and vertical positions. The pivoting seat permits the user to perform exercises in either an erect posture, or a seated posture, at the same location relative to the exercise devices. Consequently, the pivoting seat has the advantage of increasing the versatility of the universal machine with the further advantage of permitting a compact design.

In further embodiments of the invention, the erect posture exercise device includes a submerged weight bearing surface in which a looped mesh belt slides over the weight bearing surface. Alternatively, the treadmill belt has a mesh surface on its inner directed side and a nonmesh surface on its outer directed side. In a further aspect of the invention, the treadmill belt may be split into two belts permitting independent sliding motion in different directions with respect to each other. In another embodiment, skis are mounted on the weight bearing surface and have a combined width extending across the full width of the weight bearing surface. The outer edges of the skis are immediately adjacent to and slide relative to side rails bordering the weight bearing surface. The inner edges of the skis are immediately adjacent to and slide relative to each other as the skis are moved in opposite directions by the user. Therefore, the skis have the advantage of being self tracking during the simulated skiing exercise.

In another embodiment, the invention includes footwear that slides easily with regard to the submerged weight bearing surface, thereby allowing the user to simulate a sliding or skating motion and other related activities while partially or wholly submerged in water. Consequently, the invention has the advantage of providing aquatic exercises and activities not heretofore known. Those aquatic exercises and activities may be conducted in association with or without the universal aquatic exercise machine.

In a still further embodiment, the invention provides a selectively variable fluid resistance member. An iris diaphragm is used as a fluid resistance member and has a manual adjustment that changes the surface area of the diaphragm, thereby changing the resistance to motion of the diaphragm through the water. Consequently, the invention is able to easily adjust the forces required to operate the exercise devices, thereby permitting the exercise devices to be adjusted to the capabilities and needs of the user. Therefore, the iris diaphragms have the advantage of allowing the same universal aquatic machine to serve the needs of a greater number of users. In an alternative embodiment, the iris diaphragm is used as a flow control device to regulate the work required to operate an aquatic cart or an aquatic therapy pump.

These and other objects and advantages of the present invention will become more readily apparent during the following detailed description together with the drawings herein.

DETAILED DESCRIPTION OF THE INVENTION

Figure 1:
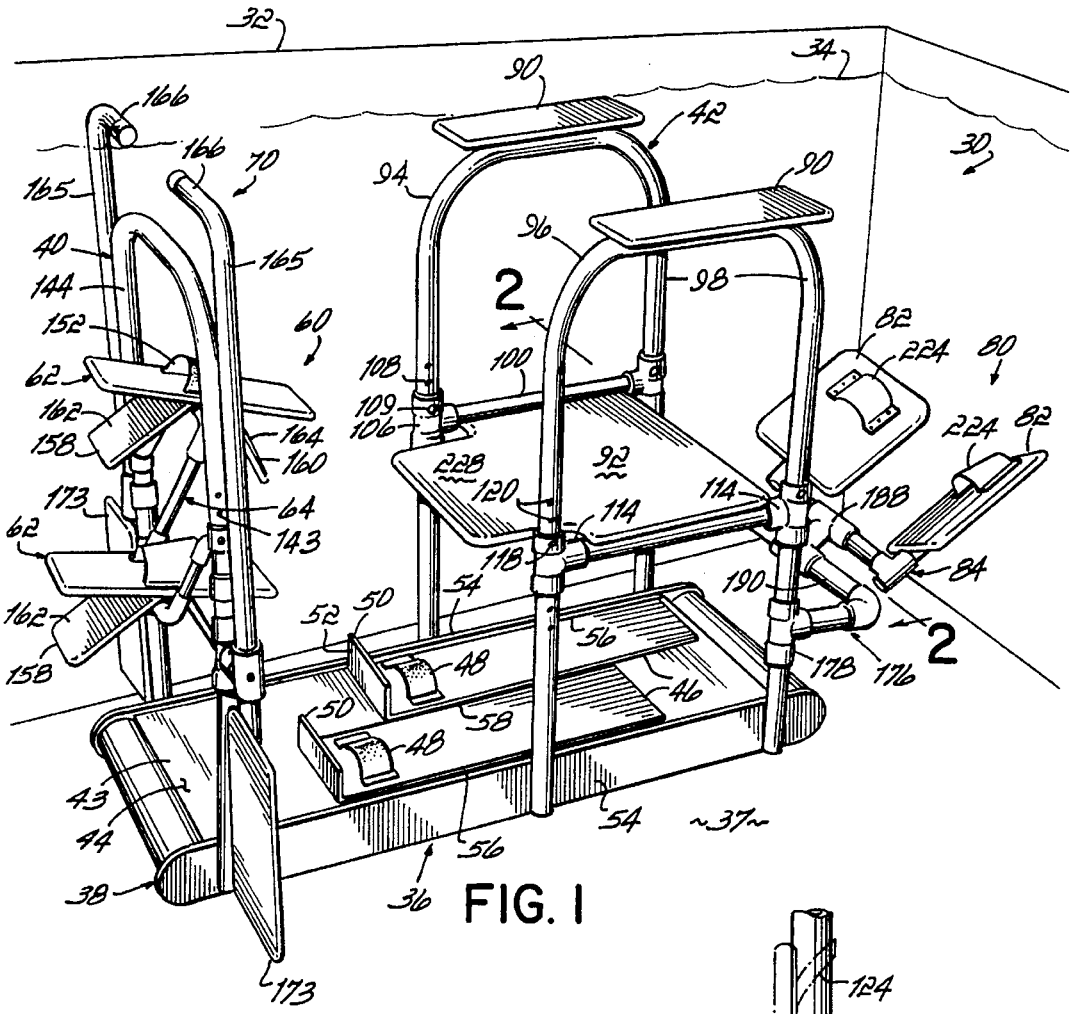
FIG. 1 is a perspective view of the universal aquatic exercise device embodying the principles of the present invention.

Referring to FIG. 1, the universal aquatic exercise machine 30 is located in a tank 32 filled with a fluid, preferably water 34. The level of the water 34 with respect to the machine 30 may be varied and is dependent on the nature of the exercise being done and the capabilities of the person using the machine 30. For proper use of the machine 30, the water level must cover the resistance elements of the exercise device being used. The machine 30 is supported by a submerged machine structure 36 which rests on a bottom surface 37 of the tank 32 and includes a base 38, a first frame structure 40 and a second frame structure 42. Base 38 includes a deck or weight bearing member 43 having an upper surface 44 which is preferably made of a low friction material such as, for example, polypropylene, ultra high molecular weight polyethylene ("UHMW PE"), polyvinylchloride ("PVC"), etc. Slidingly mounted on the surface 44 is a pair of skis 46 which include footholds 48 and resistance elements 50 which have surfaces 52 providing a resistance to motion of the skis in their longitudinal direction through the water 34. The skis 46 preferably have a low friction lower surface so that they readily slide through the water 34 over the surface 44. The base 38 has side rails 54 which preferably extend above the surface 44. The width of both of the skis 46 preferably extends preferably extends the full distance between the side rails 54 such that the outer edges 56 of the skis are immediately adjacent to and slide relative to the inner directed opposed sides of the side rails 54. Further, the opposed inner edges 58 of the skis 46 are immediately adjacent to and slide relative to each other when the skis are moved in a simulated skiing motion. Consequently, the skis 46 are self tracking and automatically remain in their proper orientation and direction while they are being used.

A first exercise device 60 rotatably connected to the first frame structure 40, the device 60 includes actuating elements or pedals 62 and crank mechanism 64 which when operated by a user move through a generally circular path of motion. A second exercise device 70 includes second actuating elements, preferably oars or poles 72 which are pivotally connected to the first frame structure 40. When operated by the user, the oars 72 pivot through arcs extending generally longitudinally with respect to the base member 38 in a reciprocating, back and forth motion. The oars 72 may be moved singularly, or in unison, in the same direction or in opposite directions.

A third exercise device 80 includes actuating elements 82 and support structure 84 pivotally connected to the second frame structure 42. When operated by the user, the actuators or pedals 82 pivot through arcs and reciprocate back and forth in a generally vertical direction with respect to the top surface 44 of the base member 38. The activating elements 82 and support structure 84 are mechanically interlocked to that they always move in opposite directions. The second frame structure 42 further includes generally horizontal support pads 90 on which the user can support themselves when using either of the exercise devices 62, 80. In addition, the second frame member 42 includes a seat 92 which permits the user to use any of the exercise devices 62, 70, 80 in a sitting posture.

Figure 2:
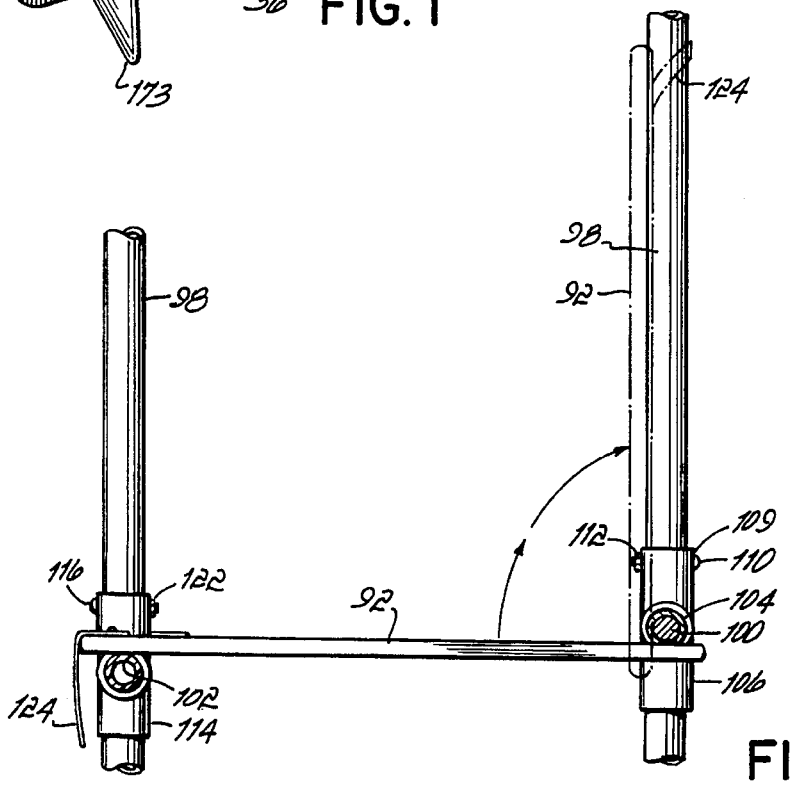
FIG. 2 is a cross-section taken along line 2—2 of FIG. 1.

The second frame structure 42 includes opposed first and second frame elements 94, 96. Each of the opposed frame elements 94, 96 have a pair of generally vertical frame members 98 on which are mounted generally horizontal frame members 100, 102. Referring to FIG. 2, the horizontal frame member 100 is preferably a solid plastic rod which is welded to the upper surface adjacent one edge of the seat 92. The ends of the rod 100 are inserted into a plastic bushings 104 which have an internal diameter sized to mate and conform with the exterior diameter of the rod 100. The bushings 104 are preferably made from a UHMW PE plastic and are pressed into the internal diameter of the central legs of the tee couplings 106. The tee couplings 106 have an internal diameter sized to conform with the external diameter of the vertical frame members 98, thereby permitting the tee couplings 106 to slide up and down on the vertical frame members 98. A series of holes 108 (FIG. 1) are drilled through the vertical frame members 98 and mating holes 109 are drilled through the tee couplings 106. A fastener, such as a pin or preferably a stainless steel screw 110, is inserted through the holes 108, 109; and a nylon nut 112 is used to secure the screw 110 in position. Consequently, the seat 92 may be located at different vertical heights with regard to the various exercise devices 60, 70, 82.

When in the horizontal position, the bottom surface of the seat 92 rests on top of the horizontal frame member 102. The horizontal frame member 102 is rigidly connected to tee couplings 114 which also have internal diameters sized to slide over the vertical frame members 98. Pins 116 are inserted through holes 118 (FIG. 1) in the tee couplings 114 and holes 120 in the vertical frame members 98 and are secured in place by a nylon nut 122. Consequently the horizontal frame member 102 on which the seat 92 rests when in the horizontal position may also be adjusted to different vertical heights. The seat 92 is preferably made from a medium or high density plastic which has a specific gravity of less than unity. Therefore, when the user leaves the sitting posture, the seat 92 and rod 100 will pivot within the bushings 104 to an approximately vertical position as shown in phantom in FIG. 2. When in that position, a strap 124 is wrapped around the vertical frame member 98 to secure the seat 92 in the vertical position. Therefore, the seat is selectively movable between horizontal and vertical positions to permit the user to operate the exercise devices 62, 70, 80 selectively in either a sitting posture or an erect posture from the same location between the vertical frame elements 94, 96.

Figure 3:
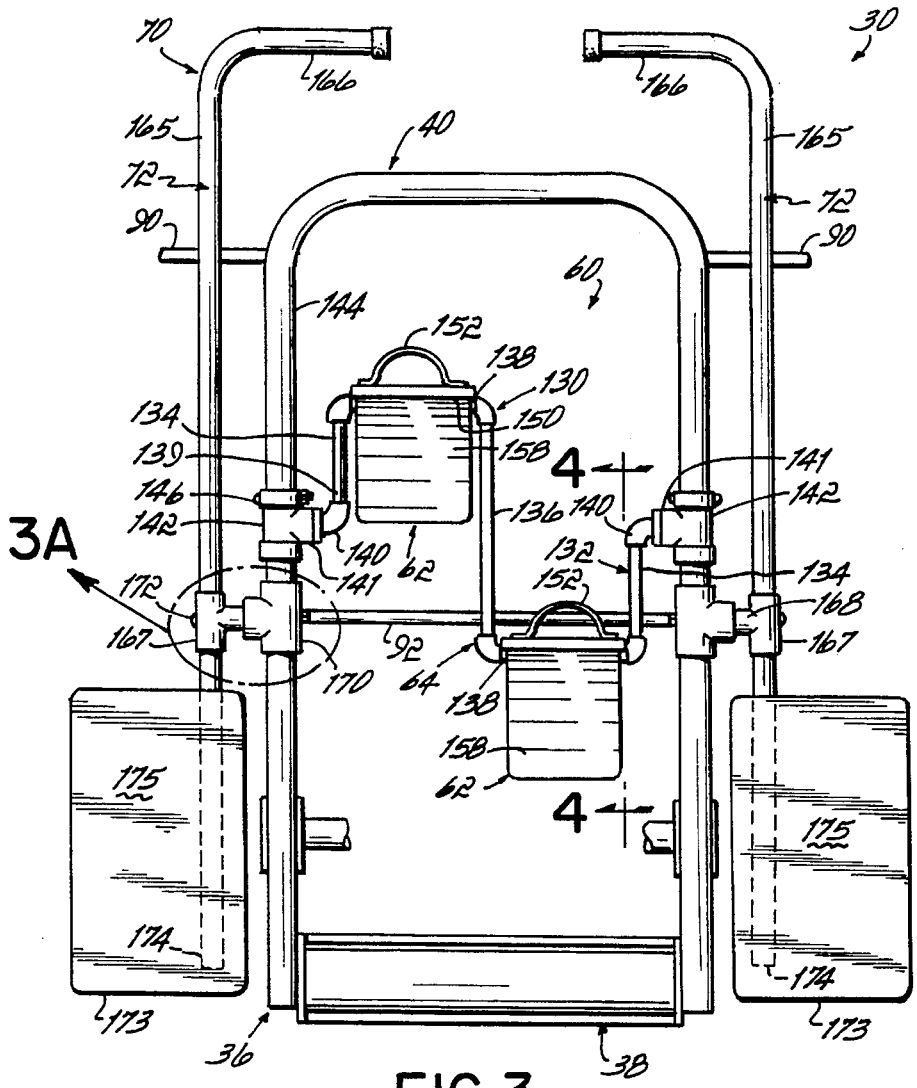
FIG. 3 is an end view of the two rotational exercise devices at one end of the universal aquatic exercise device.
Figure 4:
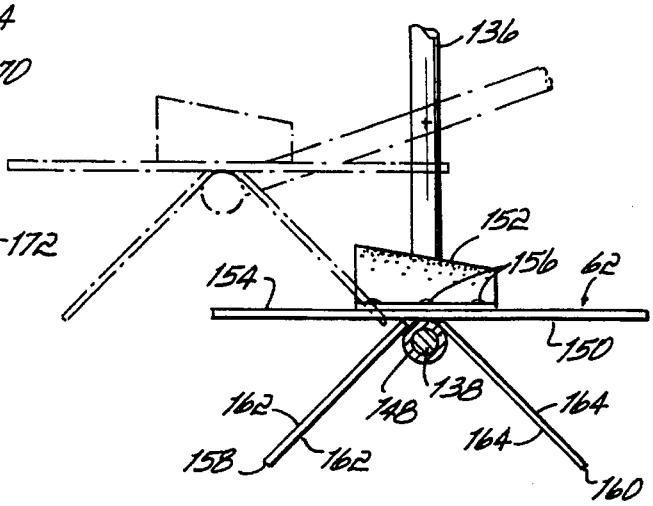
FIG. 4 is a cross-sectional view taken along line 4—4 of FIG. 3 and illustrates a pedal used on the rotational exercise device.

FIGS. 1, 3, and 4 illustrate the construction of the first exercise device 60 which includes actuating elements or pedals 62 rotatably coupled to a rotating crank structure 64. The rotating crank structure 64 includes first and second generally U-shaped members 130, 132. The frame members 130, 132 have first side legs 134, second side legs 136 and base legs 138. The distal ends 139 of the first side legs 134 have elbows 140 which are rotatably coupled to the central legs 141 of tee couplings 142 which are slidably mounted on vertical frame members 144 of the first frame structure 40. Preferably, the central legs 141 of the tee couplings 142 contain bushings (not shown) with internal bearings surfaces similar to the bushings 104 of FIG. 2. Therefore, the elbows 140 on the distal ends 139 of the first side legs 134 fit into the internal bearing diameter of those bushings to provide a smooth rotational motion. Further, preferably and in a manner similar to that illustrated in FIG. 2, screws or other fasteners 146 extend through aligned holes (not shown)in the tee couplings 142 and holes 143 (FIG. 1) vertical frame members 144 to locate and secure the exercise device 60 at different vertical elevations. The distal ends of the second side legs 136 are connected together such that the second side legs 136 form a substantially straight or linear member.

As shown in FIG. 4, the actuating elements or pedals 62 are rotatably mounted on the base legs 138 of the generally U-shaped members 130, 132. Each of the actuating elements 62 has a hollow mounting tube 148 which has an internal diameter sized to accept and pivot with respect to the base leg 138. The tube 148 is welded at a central location to the bottom surface 150 of the actuating elements 62. Consequently, the actuating elements 62 pivot about first axes of rotation that extend centrally through the base legs 138 and in addition move through a generally circular path with respect to an axis of rotation defined by the center lines of the central legs 141 of the tee couplings 142. A strap or loop 152 is mounted to the upper surfaces 154 of each actuating elements 62. The strap 152 may be rigid or flexible and is secured to the actuating element 62 by fasteners 156. The surfaces 150, 154 of the actuating elements 62 function as resistance surfaces and provide a resistance to motion of the elements 62 in the water. In addition, each of the actuating elements 62 further include resistance elements 158, 160 which have one end welded to the bottom surface 150 adjacent to the tube 148. Preferably, the first and second resistance elements are separated from each other and from the bottom surface 150 by an angle of approximately 60 degrees. However, the resistance elements 158, 160 may be connected to the lower surface 150 at any angle in the range of from 5 degrees to 85 degrees. Preferably, the resistance elements 158, 160 are positioned such that an approximately constant force is required to move the actuating elements 62 through their circular path of motion at a constant velocity independent of the angular position of the elements 62 with regard to the base leg 138. The opposing surfaces 150, 154, the opposing surfaces 162 of resistance element 158 and opposing surfaces 164 of resistance element 160 all function to provide resistance to motion of the actuating elements 62 in the water 14.

Figure 3A:
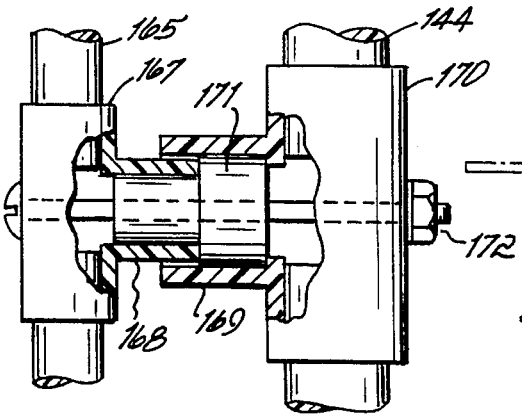
FIG. 3A is an enlarged view of the encircled portion of FIG. 3 and illustrates the coupling connecting the oars to the frame structure.

Referring to FIG. 3, the second actuating device 70 is comprised of oars 72 rotatably mounted to the first frame structure 40. The oars 72 include generally straight poles 165 having handles 166 at one end formed to be readily gripped by a user. The poles 165 have tee couplings 167 with central legs 168 that engage central legs 169 of second tee couplings 170 mounted on the vertical frame members 144 of the first frame structure 40. Referring to FIG. 3A, bushings 171 preferably made of a high density plastic, for example, UHMW PE, are sized with a first larger diameter which is press fit into the central legs 169 of the tee couplings 170. The bushings 171 have a second smaller diameter which has an external cylindrical bearing surface sized to slidingly receive the internal diameter of the central legs 168 of tee couplings 167. Fasteners, preferably, a stainless steel screw and nylon nut combination, 172 extend through the tee couplings 167 of bushings 171 and tee couplings 170 to hold the central legs 168, 169 in rotational engagement. Resistance elements 173 are mounted to the opposite ends 174 of the poles 165 and extend over a substantial length of the poles 165 between the tee couplings 167 and the opposite ends 174 of the poles 165. The tee couplings 167, 170 and bushings 171 form rotating couplings or pivot joints having axes of rotation that extend in a direction generally perpendicular to the vertical members 144 of the first frame structure 40. The axes of rotation permit the oars 72 to be reciprocated or moved back and forth through circular arcs generally parallel to the longitudinal center line of the base member 38. The resistance elements 173 have opposed surfaces 175 which are oriented to be generally perpendicular to the motion of the oars 72 and provide a resistance to motion of the oars 72 in the water 14.

Figure 5:
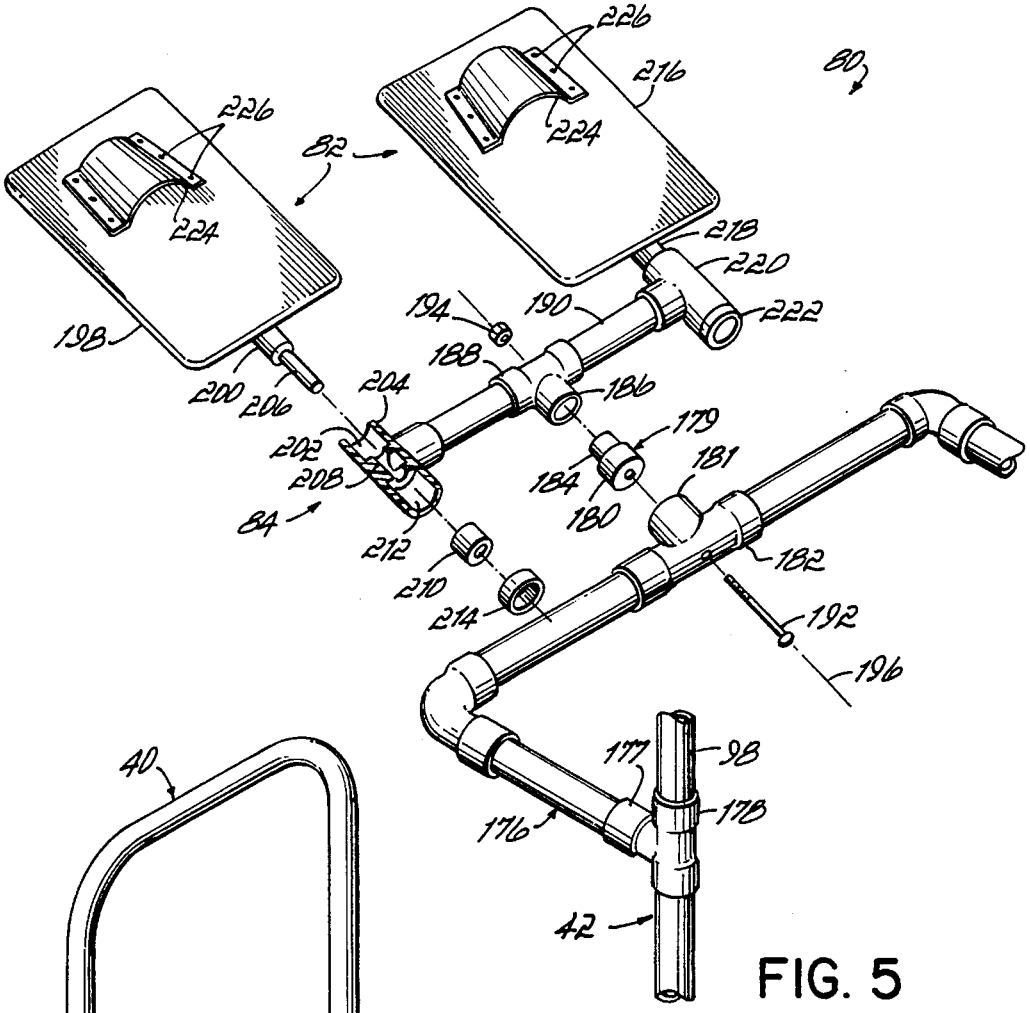
FIG. 5 is a disassembled view of the aquatic reciprocating leg exerciser on the other end of the universal aquatic exercise device.

FIG. 5 illustrates the construction of the third exercise device 80. The machine structure 36 includes a rigid, generally U-shaped frame 176, which is connected to the central legs 177 of T-couplings 178, which, in turn, are mounted on the vertical frame members 98 of the second support structure 42. A shaft 179 has a larger diameter at one end 180, which is sized to be press-fit into the inner diameter of the central leg 181 of a T-coupling 182 centrally located on the frame 176. The T-coupling 182 is oriented so that the central leg 181 extends therefrom in a generally horizontal direction. The shaft 179 has a second smaller diameter 184, which is sized to rotatably fit within the inner diameter of the central leg 186 of T-coupling 188, which is generally centrally located on the shaft or support member 190. A fastener, such as a screw 192 extends through the T-coupling 182, the shaft 179 and the T-coupling 188, and is secured by a nut 194. The fastener 192 is effective to hold the support member 190 securely on the end 184 of shaft 179. Therefore, the support member 190 is rotatably coupled to the frame 176 and rotates about an axis of rotation 196 that is generally perpendicular to and bisects the length of the support member 190.

A first pedal or actuating element 198 has a shaft 200, which is centrally located on and welded to a lower surface of the actuating element or pedal 198. The shaft 200 has a major diameter, which is sized to mate with a first diameter 202 of a T-coupling 204 rigidly connected to one end of the shaft 190. The shaft 200 has a second smaller diameter 206, which is sized to mate with a second diameter 208 of the T-coupling 204. A bushing 210 has an inner diameter that slidingly fits over the diameter 206 of shaft 200, and further has an outer diameter that mates with the diameter 212 of T-coupling 204. A ring 214 has an inner diameter which is sized to slide over the diameter 206 of the shaft 200. The outer diameter of the ring 214 is larger than the diameter 212 of the T-coupling 204. Therefore, when the ring 214 is welded or otherwise rigidly connected to the end of the shaft 200, it functions to lock the shaft 200 within the T-coupling 204. Preferably, the diameters on the shaft 200, in the tee coupling 204 and on the busing 210 are sized so that they mate in a bearing relationship with respect to adjacent diameters, thereby providing a continuous bearing contact over the length of the shaft 200, which is contained within the T-coupling 204. A second actuating element or pedal 216 has a shaft 218, which is mounted within the T-coupling 220 in a manner identical to that described with respect to the shaft 200 and T-coupling 204. A retaining ring 222 is fixed on the end of shaft 218, thereby locking it within the T-coupling 220. The actuating elements 198, 216 further have straps or looped members 224, which are fastened to the upper surfaces of the elements 198, 216 by fasteners 226.

Consequently, referring to FIG. 1, the universal aquatic exercise machine 30 readily accommodates users of different size and may be used to perform many different exercises. In use, the user first adjusts the height of the seat 92 to a desired elevation. In addition, the first exercise device 60 is adjusted to a desired elevation. The user can support themselves with their forearms laying on the supports 90 and insert their feet into the straps 52 of the actuating elements 62 of the first exercise device 60. The first exercise is performed by the user moving their legs to operate the actuating elements 62 through the generally circular path of motion. Alternatively, the same exercise can be performed by the user sitting on the seat 92. The first exercise device 60 can be further used in a third manner by the user sitting on the forward end 228 of seat 92 and inserting their hands in the straps 152 of the actuating elements 62. The first exercise device 60 is then operated by the arms of the user moving the actuating elements through their generally circular path of motion against the resistance of the water 14.

In a similar manner, the user can support themselves with their forearms on the supports 90 and insert their feet in the straps 224 of actuating elements 82 and operate the actuating elements 82 with their legs. In operation, the actuating elements 82 move back and forth in a generally vertical reciprocating motion and have generally parallel upper and lower resistance surfaces generally parallel to the direction of reciprocating motion. Those upper and lower resistance surfaces resist motion of the actuating elements 82 in the water. Alternatively, the user can stand on the actuating elements 82 in an erect posture and use their legs to move the elements 82 through the reciprocating back and forth motion. A third exercise can be performed by the user sitting on the seat 92 and using their legs to operate the pedals 82 of the exercise device 80.

As previously described, the seat 92 can be moved to a generally vertical position so that the user can exercise in an erect posture between the frame elements 94, 96 and adjacent the vertically positioned seat 92. For example, the user can stand on the surface 44, grab the handles 166 of the oars 72 on the exercise device 70 and use their arms to move the oars 72 back and forth in a reciprocating motion. Alternatively, the user can combine that exercise with the skis by placing their feet in the footholds 48 of the skis 46 and move their legs so that the skis slide back and forth in a generally longitudinal direction on the surface 44. The user can also operate the skis 46 alone by holding on the first support structure 40.

There are several alternative embodiments of the universal aquatic exercise machine 30 of FIG. 1. For example, referring to FIG. 6, the deck 43 of the base 38 which bears the weight of the user is rigidly connected along its sides to and between side rails 54. The deck 43 has a flat smooth upper surface 44. Adjacent the ends of the deck 43 are non-rotating curved end pieces 234, which are rigidly connected to and extend between these side rails 54. The end pieces 234 are located such that their outer curved surfaces tangentially intersect a plane which is common with the upper surface 44 of the deck 43.

An endless looped meshed belt 240 is mounted over the deck 43 and the non-rotating curved end pieces 234. The belt 240 slides over the upper surface 44 of the deck 43 in response to a striding or walking action of the user. The side rails 54 extend a predetermined distance above the surface 44 and are effective to cause the meshed belt 240 to track therebetween. The mesh construction of the belt minimizes the surface area of the belt in contact with the upper surface 44. Therefore, there is significantly less frictional force between the mesh belt 240 and the upper surface 44 than exists with a solid belt. To further reduce friction, the belt is made from a UHMW plastic material. The endless mesh belt preferably has a diamond mesh pattern that is the range of approximately 0.04 square inches to approximately 1 square inch. The preferred mesh has a mesh pattern of approximately 0.36 square inch. The mesh fiber preferably has a size that ranges from approximately 0.01 inch in diameter to approximately 0.25 inches in diameter, and preferably the mesh fiber is 0.035 inches in diameter.

The meshed belt 240 moves over the top surface 44 of the deck 43 around and beneath the end pieces 234 and below the deck 43 and between the side rails 54. To prevent the belt 240 from touching and dragging along the bottom surface of the tank, a cross member (not shown) is connected to and extends between the side rails 54. A lower flight of the belt is located above the cross member, thereby holding the lower flight of the mesh belt 240 off of the bottom of the tank. When the user is in the water, the buoyancy of the user reduces the vertical force being exerted on the belt 240, thereby reducing the frictional force between the belt 240 and the top surface 34 of the deck 43. Consequently, as a user begins a walking or striding motion, the user will apply a force to the belt that has a horizontal component that is effective to move the belt 240 in a sliding motion over the upper surface 44 of the deck 43. Minimal friction forces result because the belt 240 is made from the meshed material which permits a more consistent stride with less effort. The upper surface 44 of the deck 43 is made from a hard dense material, which is both smooth and resistant to the corrosive effects of sanitation chemicals added to the water in which the machine 30 is contained. Preferably, the deck is made from many medium or high density plastic material, a polished stainless steel, or any non-corrosive alloy. Further, the reduced friction permits the use of non-rotating fixed end pieces 54. The side rails 234 track the belt, and no adjustment mechanisms are required for that purpose.

Figure 6:
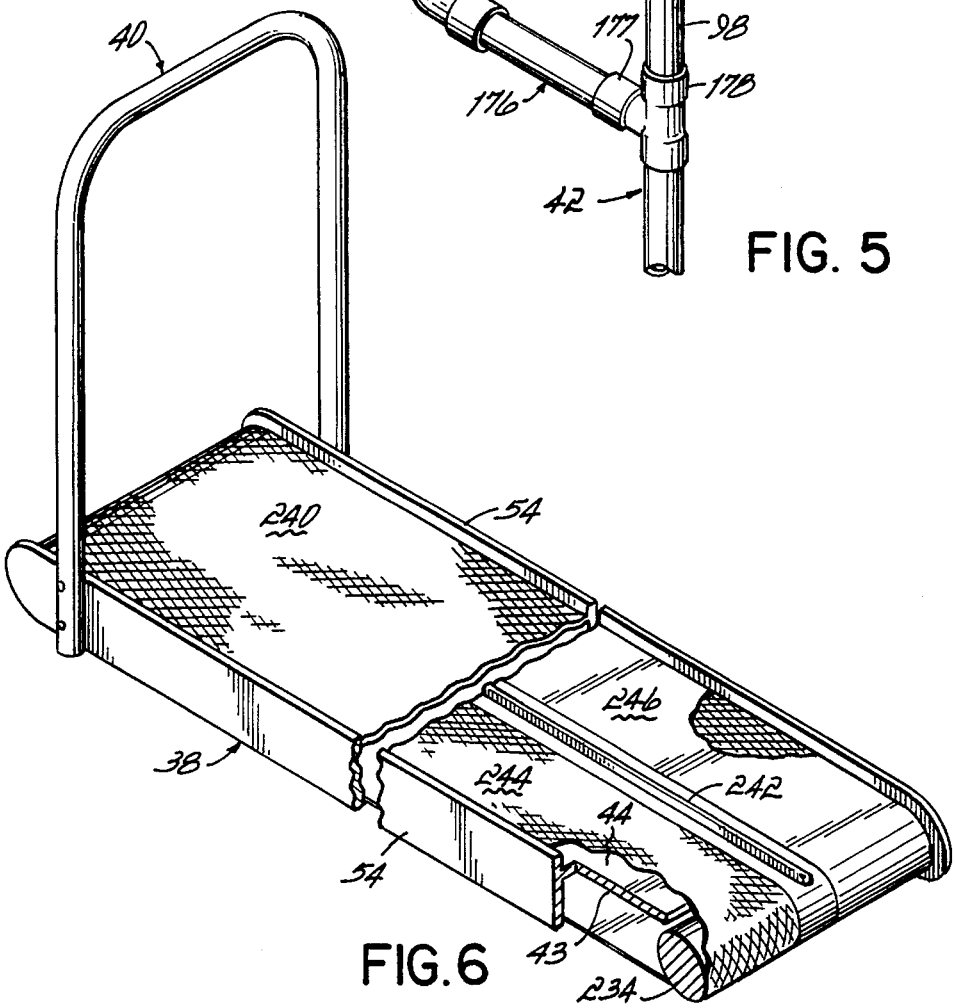
FIG. 6 is a perspective view of a mesh treadmill that may be used with the universal aquatic exercise device and an alternative embodiment of the treadmill.

In a further embodiment shown in FIG. 6, a longitudinal dividing rail 242 is attached to the upper surface 44 of the deck 43 such that the rail longitudinally bisects the upper surface 44. With this embodiment, two meshed belts 244 and 246 are placed around the deck 43 and between the dividing rail 242 and the side rails 54. The mesh belts 244, 246 may be moved independently and in different directions. Therefore, the two meshed belts 244, 246 can be used to simulate a sliding ski motion, however, the skis are not required. As further illustrated in FIG. 6, the belt 246 may be made to present the meshed textured lower surface against the surface 44 of the deck 43. However, a different textured non-mesh surface which is more dense and either rougher or smoother as preferred than the mesh surface may be manufactured on the outer surface of the belt 246 on which the user strides.

Figure 7:
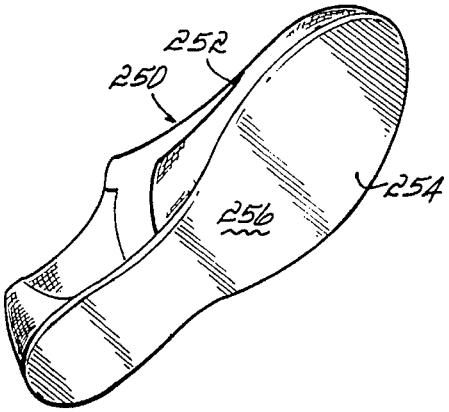
FIG. 7 is a perspective view of footwear with a sole that may be used for sliding or skating type activity under water.

As illustrated in FIG. 7, a further embodiment of the invention includes aquatic footwear 250 that may be worn when the user is engaged in exercises and activities in which the feet are submerged under water. The footwear 250 preferably has a pliable soft upper member 252 which fits over the user's foot and is preferably secured by a "VELCRO" strap (not shown). The sole 254 of the footwear 250 may have many different configurations depending on the exercise, activity, user preference, etc. For example, as shown in FIG. 7, the sole 254 is a flat, smooth surface 256 which is constructed from a medium density or high density plastic material, for example, polypropylene, UHMW PE, PVC, etc. The material is chosen so that the sole 254 slides easily over the surface 44. Consequently, when wearing the footwear 250 with the sole 256, the users feet will slide easily over the surface 44, and the user can simulate a back and forth skiing motion. Consequently, that exercise may be done without using the skis 46 of FIG. 1 or the meshed belts 244, 246 of FIG. 6.

Figure 9:
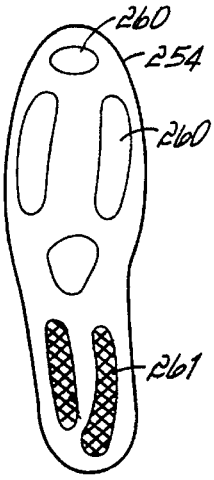
Figure 10:
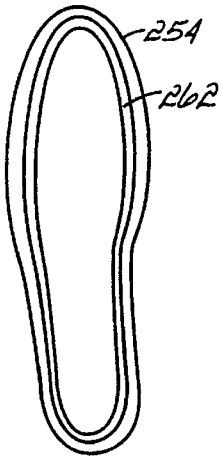

The sole 254 of the footwear 250 may have other types of treads or surfaces depending on the activity. For example, the sole 254 may have a plurality of sliding cleats 258 attached thereto which are also made of the medium density or high density plastic material. As shown in FIG. 9, the sole 254 may alternatively have a plurality of raised pads 260 made of a medium density or high density plastic material. Each of the pads 260 presents a flat surface raised from or offset from the surface of the sole 254 which contacts the surface 44. Alternatively, the pads as shown at 261 may be made of a mesh material. In another embodiment as illustrated in FIG. 10, the sole 254 may have a closed ring or rim 262 of the medium density or high density plastic material which provides a raised flat surface offset from the sole 254 for contacting the surface 44.

Figure 11:
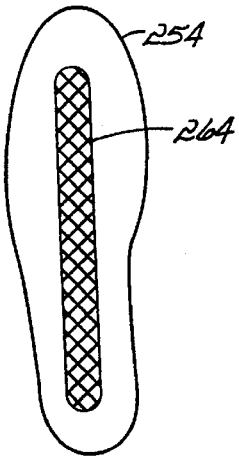
Figure 12:
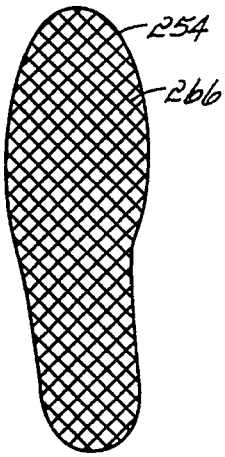

In another variation of the sole design 254 shown in FIG. 11, the contact area of the footwear 250 is limited to a rail member 264 which extends generally centrally and longitudinally over the sole 254. The rail member 264 of FIG. 11 has a mesh material bonded or otherwise attached to its surface so that the mesh on the rail 264 provides the contact with the surface 44. FIG. 12 illustrates that the sole 254 may contain a mesh 266 over its entire area providing footwear similar to that shown in FIG. 7. The choice of using a mesh or a flat medium density or high density plastic material, such as 256, is a matter of choice of the user and will also depend on the nature of activity undertaken while wearing the footwear 250.

Figure 16:
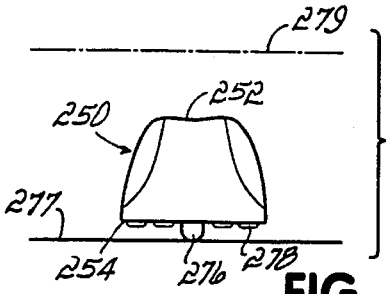
FIGS. 8–16 are alternative embodiments of the structure of the sole of the footwear of FIG. 7.
Figure 8:
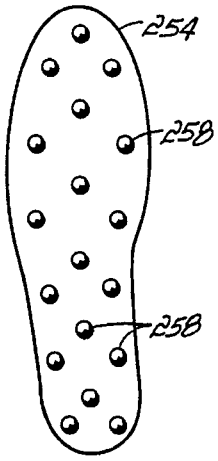
Figure 13:
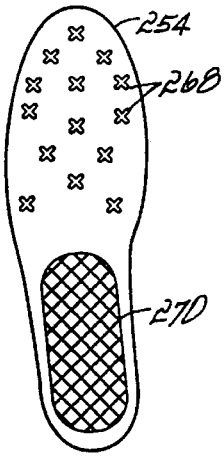
Figure 14:
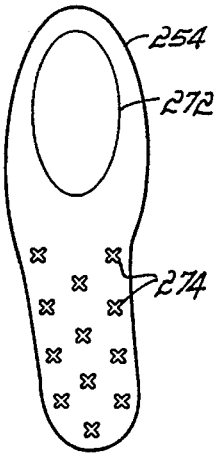
Figure 15:
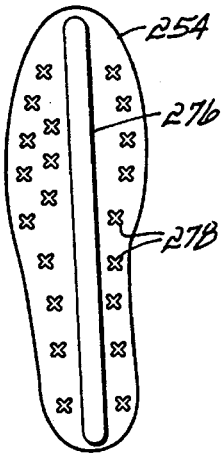

In addition to using the footwear 250 in association with the universal aquatic exercise machine illustrated in FIG. 1, the footwear 250 may also be used on any submerged smooth surface for aerobic sliding, skating, running, walking, or other exercises. In those situations, the user must be able to start, stop, change direction through the use of their legs and feet. Therefore, preferably the footwear 250 must have a high resistance or traction surface in addition to the lower resistance sliding surface. In one embodiment, for example, as shown in FIG. 13, the sole 254 includes a high resistance traction surface provided by traction cleats 268 under the forward area of the foot that includes the toes and the ball of the foot. A lesser resistance sliding surface is provided under the rear portion or heel area of the sole 254 by means of a mesh 270. Those elements may be reversed as illustrated by the sole 254 in FIG. 14. A sliding area is provided by the medium density or high density plastic 272 located under the forward portion of the sole 254 such that the toes and ball of the foot will slide on the surface. However, traction cleats 274 are located on the rearward portion of the sole 254 so that when the user wishes to change direction or stop, more weight is put on the heel area of the sole 254. The sole 254 may be provided with generally centrally longitudinal rail 276 which is surrounded on both sides by a traction area provided by traction cleats 278. Preferably, as illustrated in FIG. 16, the rail is made of a medium density to high density plastic material and has the convex cross-sectional shape contacting a smooth bottom surface 277 under the water 279.

Figures 17, 18, 19:
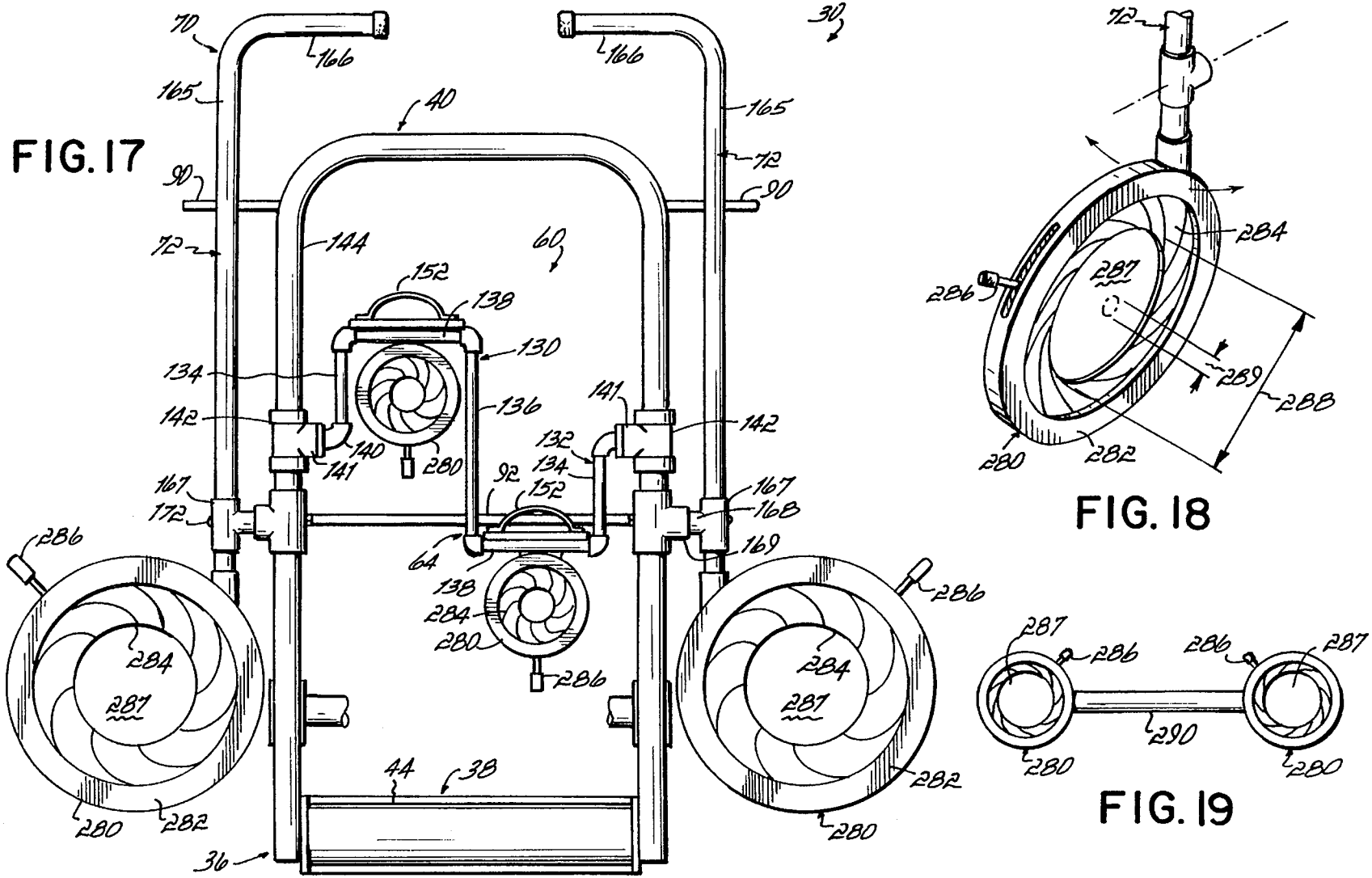
FIG. 17 is an alternative embodiment of a fluid resistance element that uses an iris diaphragm for providing a selectively variable resistance to motion of an aquatic exercise device in the water.
FIG. 18 is a diagramatic perspective view of an iris diaphragm.
FIG. 19 is a schematic diagram illustrating the use of iris diaphragms on aquatic dumbbells.

In a further embodiment of the invention, the fluid resistance surfaces, such as the surfaces 175 of the paddles 173 of exercise device 70 of the universal aquatic exercise machine 30 illustrated in FIGS. 1 and 4, may be replaced by devices that provide resistance elements having selectively variable surface areas. If the resistance elements have variable surface areas, the resistance to motion of the resistance elements in the fluid can be selected and changed; and therefore, the forces required to operate the exercise device can be calibrated to the capabilities of the user. In one embodiment, as illustrated in FIG. 17, the fixed resistance elements 173 are replaced by variable resistance elements 280. The variable resistance elements 280 are preferably iris diaphragms similar in operation to those commercially available from optic suppliers such as Edmond Scientific Co. of Barrington, N.J. While the commercially available iris diaphragms have diameters up to four inches, it is contemplated that the iris diaphragms in accordance with the principles of the present invention could be in a range of up to thirty inches in diameter. Referring to FIG. 18, the iris diaphragms 280 include a housing 282, a plurality of adjustable shutter elements 284, and an adjusting lever 286. By moving the lever 286 in one direction, the shutter elements 284 open, increasing the area and size of the opening 287 to a first diameter 288. When adjusted to provide a larger opening, there is less resistance to motion of the iris diaphragm through the water and smaller forces are required to operate the exercise device. Moving the lever in the other direction causes the shutter elements to close thereby reducing the area or size of the opening 287 to a smaller diameter 289 shown in phantom in FIG. 18. When adjusted to the smaller diameter, there is more resistance to motion of the iris diaphragm through the water and correspondingly larger forces are required to operate the exercise device. As shown in FIG. 19, iris diaphragms 280 may be applied to static exercise devices such as an aquatic dumbbell 290, and therefore, the forces required to move the dumbbell 290 through water can then be varied. Consequently, the single dumbbell 290 with the adjustable iris diaphragms 280 on its ends may replace a series of dumbbells having different fixed surface areas and weights.

The iris diaphragm may be used to regulate the forces required to operate other aquatic devices. For example, an aquatic cart in water (not shown) is propelled by a user pushing on pedals which rotate a crank mechanism that drives a propeller. Rotation of the propeller pulls water through an inlet and exhausts the water through an outlet past rudder. The forces required to operate the water cart can be adjusted, controlled or regulated by using an iris diaphragm at either the inlet or the outlet. The iris diaphragm is adjusted to provide a central orifice of a size that limits the desired volume or flow of water available to the propeller, thereby changing the relationship between the forces required to drive or move the water cart and the speed of the water cart.

The iris diaphragm may also be used to control the flow through a pump (not shown), such as a high volume, low pressure axial flow pump submerged in water. The pump is typically powered by an electric motor which is rotatably coupled to a shaft driving a pump propeller or impeller. An iris diaphragm is located at either an inlet or an outlet of the pump. By adjusting the orifice of the iris diaphragm, the flow of water through the pump is adjusted and varied without having to change the speed of the pump drive motor. Therefore, if a user is swimming or striding on a treadmill against the direction of flow from the pump output, the forces that must be exerted by the user to overcome the fluid resistance presented by the flow from the pump output are adjustable using the iris diaphragm.

While the invention has been set forth by a description of the embodiment in considerable detail, it is not intended to restrict or in any way limit the claims to such detail. Additional advantages and modifications will readily appear to those that are skilled in the art. For example, the first and second frame structures, 40, 42, respectively, (except for horizontal frame member 100,) first and second generally U-shaped frame members 130, 132, respectively, poles 165, U-shaped frame member 176, support member 190, shaft 200 and their associated tee couplings and elbows are preferably made from commercially available PVC pipe materials. Those structural members may also be made from stainless steel, a noncorrosive alloy, a composite reinforced thermoset polymer or any combination of the above materials. The actuating elements 62, 82, resistance elements 158, 160, 173 can be made from any rigid sheet plastic material, and the skis 46 have a bottom surface that is preferably made from a polypropylene or medium or high density polyethylene. Other materials providing the desired frictional properties and noncorrosiveness may also be used.

The skis 46 have resistance elements 50 preferably located at the forward end of the skis. Alternatively, the resistance elements may be located at the rear end of the skis, or resistance elements may be located at both ends of the skies, or the skis may be used without any resistance elements. Preferably, the meshed belt is made from "DELRIN", nylon, high density polyethylene, other high density thermoplastics; however, the meshed belt may be made from a thermoset polymer, a composite reinforced plastic, a thermal plastic elastomer, interlocking metal links in a meshed pattern, or other materials that are manufactured with a mesh pattern with a smooth surface that provide reasonably little friction between the meshed belt and the upper surface of the deck. Further, the skis may be used directly on the meshed belt, or, the meshed belt may be replaced by a piece of mesh material which is fixed to the weight bearing surface over which the skis move. Or, pieces of mesh material may be fixed to the bottom surfaces of the skis so that the skis move easily with respect to the weight bearing surface.

The invention therefore in its broadest aspects is not limited to the specific details shown and described. Accordingly, departures may be made from such details without departing from the spirit and scope of the invention.

What is claimed is:

1. An exercise machine utilizing a resistance of a liquid comprising:

a frame structure adapted to be submerged in the liquid;

a first exercise device including a pair of actuating elements rotatably mounted to the frame structure to move in a generally circular path and adapted to be submerged in the liquid, each of the actuating elements having an upper surface adapted to be pushed by a user and a lower surface to provide resistance to motion of the actuating elements in the liquid in response to actuation by a user;

a second exercise device including a pair of actuating elements rotatably connected to the frame structure and adapted to be submerged in the liquid, each of the actuating elements moving in a reciprocating motion having an upper surface adapted to be pushed by a user and a lower surface to provide resistance to motion of the actuating element in the liquid in response to actuation by the user; and a third exercise device including a pair of actuating elements operably mounted on the frame structure and adapted to be submerged in the liquid, the actuating elements adapted to be operated by a user and having surfaces providing resistance to reciprocating motion of the actuating elements in the liquid in response to actuation by the user.

2. The exercise device of claim 1 further comprising a seat rotatably coupled to the frame structure and selectively movable between a first horizontal position in which opposing edges of the seat are supported by the frame structure and a second generally vertical position.

3. The exercise machine of claim 1 further comprising two spaced apart generally horizontal pads connected to the frame structure for supporting the user.

4. The exercise machine of claim 1 wherein the frame structure further comprises:

a weight bearing surface; and a sliding member adapted to be submerged in the liquid and mounted on the weight bearing surface, the sliding member sliding with respect to the weight bearing member in response to forces generated by the user in the liquid.

5. The exercise machine of claim 4 wherein the third exercise device is a pair of oars pivotally mounted to the frame structure and including resistance elements providing a resistance to motion of the oars in the liquid.

6. The exercise machine of claim 1 wherein the third exercise device is a pair of skis in sliding contact with a weight bearing member on the frame structure.

7. An exercise device utilizing a resistance of a liquid comprising:

a base;

a weight bearing member connected to the base and having an upper surface adapted to be submerged in the liquid;

at least one sliding member adapted to be submerged in the liquid and mounted on the weight bearing member in sliding contact with the upper surface of the weight bearing member in response to forces generated by a user in the liquid;

a frame structure adapted to be submerged in the liquid and connected to the base, the frame structure having at least one generally vertical frame member; and two oars, each of the oars having a generally straight pole having a first end adapted to be gripped by a user, a pivot joint located intermediate the first end and a second end of the pole and connecting the pole to the vertical frame member, the pivot joint permitting the oar to pivot about an axis of rotation approximately perpendicular to the pole; and a surface providing resistance to motion of the oar in the liquid, the surface extending substantially between the pivot joint and the second end of the pole.

8. The exercise device of claim 7 wherein the sliding member comprises a looped belt mounted on the weight bearing member.

9. The exercise device of claim 7 wherein at least one sliding member comprises a pair of skis.

10. An exercise device utilizing a resistance of a liquid comprising:

a base;

a weight bearing member connected to the base and having an upper surface adapted to be submerged in the liquid;

a pair of side members adapted to be submerged in the liquid and connected to two parallel longitudinal edges of the weight bearing member, the pair of side members having opposed inner directed surfaces extending a predetermined distance above the upper surface;

a pair of sliding members adapted to be submerged in the liquid and having top and bottom opposed surfaces, the top surface of each of the sliding members being adapted to receive a foot of a user and the bottom surface contacting the upper surface in a sliding reciprocating motion therewith, the pair of sliding members having longitudinal, outer directed edges immediately adjacent to the inner directed surfaces of the pair of side members and opposed longitudinal, inner edges immediately adjacent each other to cause the pair of sliding members to automatically track and maintain a desired direction of motion in response to relative reciprocating motion with respect to each other;

a frame structure adapted to be submerged in the liquid and connected to the base, the frame structure having at least one generally vertical frame member; and two oars, each of the oars having a generally straight pole having a first end adapted to be gripped by a user, a pivot joint located intermediate the first end and a second end of the pole and connecting the pole to the vertical frame member, the pivot joint permitting the oar to pivot about an axis of rotation approximately perpendicular to the pole; and a surface providing resistance to motion of the oar in the liquid, the surface located between the pivot joint and the second end of the pole.

11. An exercise device utilizing a resistance of a liquid comprising:

a base;

a weight bearing member connected to the base and having an upper surface adapted to be submerged in the liquid; and at least one sliding member adapted to be submerged in the liquid and mounted on the weight bearing member in sliding contact with the upper surface of the weight bearing member in response to forces generated by a user in the liquid;

a frame structure adapted to be submerged in the liquid and connected to the base; and first and second actuating elements adapted to be submerged under the liquid and rotatably coupled to the frame structure to move in a generally circular path, each of the first and second actuating elements having an upper surface adapted to be pushed by a user, and at least one resistance element having one end connected to a lower surface of a respective actuating element and providing resistance to motion of the actuating elements.

12. An exercise device utilizing a resistance of a liquid comprising:

a base;

a weight bearing member connected to the base and having an upper surface adapted to be submerged in the liquid; and at least one sliding member adapted to be submerged in the liquid and mounted on the weight bearing member in sliding contact with the upper surface of the weight bearing member in response to forces generated by a user in the liquid;

a frame structure adapted to be submerged in the liquid and connected to the base; and a support member rotatably coupled to the frame to pivot about a first axis of rotation extending from one side of the support member, the first axis of rotation being generally perpendicular to and bisecting a length of the support member;

a first element adapted to be submerged in the liquid and having a surface providing resistance to motion of the first element through the liquid, the first element being rotatably coupled to one end of the support member and having a second axis of rotation extending from an opposite side of the support member in a direction generally parallel to the first axis of rotation; and a second element adapted to be submerged in the liquid and having a surface providing resistance to motion of the second element through the liquid, the second element being rotatably coupled to an opposite end of the support member and having a third axis of rotation extending from the opposite side of the support member in a direction generally parallel to the first and second axes of rotation, the first and second elements being adapted to be alternatively pushed by a user and move through a reciprocating cycle wherein the first and the second elements move generally vertically in opposite directions.

13. An exercise device utilizing a resistance of a liquid comprising:

a base;

a first frame structure adapted to be submerged in the liquid and connected to the base;

first and second actuating elements adapted to be submerged under the liquid and rotatably coupled to the frame structure to move in a generally circular path, each of the first and second actuating elements having an upper surface adapted to be pushed by a user, and at least one resistance element having one end connected to a lower surface of a respective actuating element and providing resistance to motion of the actuating elements a second frame structure adapted to be submerged in the liquid and connected to the base;

a support member rotatably coupled to the second frame structure to rotate about a first axis of rotation extending from one side of the support member, the first axis of rotation being generally perpendicular to and bisecting a length of the support member;

a third actuating element adapted to be submerged in the liquid and having a surface providing resistance to motion of the third actuating element through the liquid, the third actuating element being rotatably coupled to one end of the support member and having a second axis of rotation extending from an opposite side of the support member in a direction generally parallel to the first axis of rotation; and a fourth actuating element adapted to be submerged in the liquid and having a surface providing resistance to motion of the fourth actuating element through the liquid, the fourth actuating element being rotatably coupled to an opposite end of the support member and having a third axis of rotation extending from the opposite side of the support member in a direction generally parallel to the first and second axes of rotation, the third and the fourth actuating elements being adapted to be alternatively pushed by a user and move through a reciprocating cycle wherein the third and the fourth actuating elements move in opposite directions.

14. An exercise device utilizing a resistance of a liquid comprising:

a frame structure adapted to be submerged in the liquid;

first and second actuating elements adapted to be submerged under the liquid and rotatably coupled to the frame structure to move in a generally circular path, each of the first and second actuating elements having an upper surface adapted to be pushed by a user, and at least one resistance element having one end connected to a lower surface of a respective actuating element and providing resistance to motion of the actuating elements two oars, each of the oars having a generally straight pole having a first end adapted to be gripped by a user, a pivot joint located intermediate the first end and a second end of the pole and connecting the pole to the frame structure, the pivot joint permitting the oar to pivot about an axis of rotation approximately perpendicular to the pole; and a surface providing resistance to motion of the oar in the liquid.

15. An exercise device utilizing a resistance of a liquid comprising:

a frame structure adapted to be submerged in the liquid;

first and second actuating elements adapted to be submerged under the liquid and pivotally coupled to the frame structure to move in a generally reciprocating motion, each of the first and second actuating elements include a first surface adapted to be pushed by a user;

two oars, each of the oars having a generally straight pole having a first end adapted to be gripped by a user, a pivot joint located intermediate the first end and a second end of the pole and connecting the pole to the frame structure, the pivot joint permitting the oar to pivot about an axis of rotation approximately perpendicular to the pole; and a surface providing resistance to motion of the oar in the liquid.

16. An exercise device utilizing a resistance of a liquid comprising:

a base member;

actuating elements rotatably connected to the base and adapted to be submerged in the liquid and to be operated by a user, the actuating elements having surfaces providing resistance to motion of the actuating elements in the liquid;

a frame structure connected to the base member and adapted to be submerged in the liquid, the frame structure comprising opposed first and second frame elements, one of the frame elements including a support member;

a seat member adapted to support a user in a generally sitting posture, the seat pivotally connected to the support member along one side, and being selectively pivoted with respect to a generally horizontal pivot axis between a generally horizontal position and a generally vertical position, thereby permitting the user to operate the actuating elements in first, a sitting posture between the frame elements when the seat is in the generally horizontal position, and second, an erect posture between the frame elements when the seat is in the generally vertical position.

17. The exercise device of claim 16 wherein the seat member further comprises a top surface located on a bottom side of the support member and a bottom surface contacting and bearing against an upper side of a second support member when the seat is in the generally horizontal position.

18. An exercise device utilizing a resistance of a liquid comprising:

a frame adapted to be submerged in the liquid;

a support member rotatably coupled to the frame to rotate about a first axis of rotation extending from one side of the support member, the first axis of rotation being generally perpendicular to and bisecting a length of the support member;

a first actuator adapted to be submerged in the liquid and having a surface providing resistance to motion of the first actuator through the liquid, the first actuator being rotatably coupled to one end of the support member and having a second axis of rotation extending from an opposite side of the support member in a direction generally parallel to the first axis of rotation; and a second actuator adapted to be submerged in the liquid and having a surface providing resistance to motion of the second actuator through the liquid, the second actuator being rotatably coupled to an opposite end of the support member and having a third axis of rotation extending from the opposite side of the support member in a direction generally parallel to the first and second axes of rotation, the first and the second actuators being adapted to be alternatively pushed by a user and move through a reciprocating cycle wherein the first and the second actuators move in opposite directions.

19. The exercise device of claim 18 wherein the second and third axes of rotation are perpendicular to the length of the support member.

20. The exercise device of claim 18 wherein the second and third axes of rotation are equidistant from the first axis of rotation.

21. The exercise device of claim 18 further comprising:

a first plastic collar extending from the frame;

a second plastic collar extending from the one side of the support member;

a shaft having a low coefficient of friction in the liquid with one of the first and the second plastic collars, the shaft having one end sized to be slidably and rotatably mounted within the one of the first and the second plastic collars, and the shaft having an opposite end sized to fit in the other of the first and the second plastic collars;

a clamp extending between the first and the second plastic collars for holding the first and the second plastic collars on the shaft.

22. The exercise device of claim 21 wherein the plastic collars are base legs of a PVC tee coupling.

23. The exercise device of claim 18 further comprising:

a hollow plastic tee having a centrally located base leg connected to the one end of the support member at an orientation causing a centerline extending through two tubular lateral legs of the plastic tee to be substantially parallel to the first axis of rotation, the plastic tee further having a larger inside diameter in the two tubular lateral legs and a smaller diameter in tubular passage connecting the two tubular connecting legs;

a shaft having one end extending through the two tubular lateral legs and the tubular passage, the shaft having a first larger diameter sized to slidingly and rotatably mate with the larger inside diameter of one of the two tubular lateral legs and a second smaller diameter sized to slidingly and rotatably mate with the smaller diameter in the tubular passage;

a tubular collar having an internal diameter sized to slidingly mate with the second smaller diameter of the shaft extending through the other of the two tubular lateral legs, and the collar having an outer diameter sized to slidingly mate with the first larger diameter of the other of the two tubular lateral legs, the shaft and the collar forming a rotatable bearing and coupling extending through the two tubular lateral legs and the tubular passage; and a retainer rigidly connected to the one end of the shaft and having a size greater than the first larger diameter of the other of the two tubular lateral legs to prevent the shaft from being removed from the tee.

24. An exercise device utilizing a resistance of a liquid comprising:

a frame structure adapted to be submerged in the liquid and having two parallel frame members;

a first member adapted to be submerged in the liquid and having a first side leg, a second side leg, and a base leg extending between ends of the first and the second side legs of the first member, a distal end of the first side leg of the first member being rotatably coupled to a first of the two parallel frame members to rotate about a first axis of rotation;

a second member adapted to be submerged in the liquid and having a first side leg, a second side leg, a base leg extending between ends of the first and the second side legs of the second member, a distal end of the first side leg of the second member being rotatably coupled to a second of the two parallel frame members to rotate about a second axis of rotation substantially parallel to the first axis of rotation, and a distal end of the second side leg of the first member being connected to and forming a substantially straight line with a distal end of a second side leg of the second member, wherein the first and second members form a unitary structure and are rotatable in unison with respect to the first and second axes of rotation;

first and second actuating elements adapted to be submerged under the liquid and rotatably coupled to the first and second members, respectively, to provide third and fourth axes of rotation, respectively, substantially parallel to the first and second axes of rotation, each of the first and second actuating elements having at least two fixed nonparallel surfaces providing resistance to motion of the first and second actuating elements through the liquid.

25. The exercise device of claim 24 wherein the first and second members are substantially U-shaped members.

26. The exercise device of claim 24 wherein the first and second axes of rotation are substantially parallel.

27. The exercise device of claim 24 wherein the first and second axes of rotation are substantially perpendicular to the two frame members.

28. The exercise device of claim 24 wherein each of the first and second actuating elements further comprises:

a first fixed surface adapted to be pushed by a user to move the respective first and second members in a generally circular motion; and a second fixed nonparallel surface providing resistance to motion of the respective one of the first and second actuating elements in the liquid.

29. The exercise device of claim 24 wherein each of the first and second actuating elements further comprises:

a first fixed surface adapted to be pushed by a user to move the respective first and second members in a generally circular motion; and a resistance element having one end rigidly connected to the respective one of the first and second elements at a location generally below the first surface, the resistance element having a surface nonparallel to the first fixed surface and providing resistance to motion of the respective one of the first and second actuating elements in the liquid.

30. The exercise device of claim 29 wherein each of the first and second actuating elements has a plurality of surfaces oriented to provide a generally equal resistance force throughout the generally circular path of motion.

31. The exercise device of claim 24 wherein the resistance element is connected in a generally perpendicular relationship to the first surface.

32. The exercise device of claim 24 wherein each of the first and second actuating elements further comprises a second resistance element having a surface providing resistance to motion of the respective one of the first and second actuating elements in the liquid.

33. The exercise device of claim 32 wherein the one end of the second resistance element is connected to the second surface.

34. The exercise device of claim 33 wherein one of the first and second resistance elements is connected to the second surface at an oblique angle.

35. The exercise device of claim 34 wherein both of the first and second resistance elements are connected at oblique angles to the second surface and to each other.

36. The exercise device of claim 35 wherein the oblique angles are approximately 60°.

37. The exercise device of claim 35 wherein the first and second resistance elements are connected to the second surface at oblique angles in the range of from approximately 5° to approximately 85°.

38. An exercise device of claim 24 wherein the legs of the first and second members are made of a resilient material permitting a flexing of the first and second members to selectively disconnect and reconnect the rotatable couplings of the of the distal ends of the first side legs of the first and second members with respective frame members.

39. An exercise device utilizing a resistance of a liquid comprising:

a weight bearing member having an upper surface adapted to be submerged in the liquid for supporting a user;

a frame structure adapted to be submerged in the liquid and having at least one generally vertical frame member;

two oars, each of the oars having a generally straight pole having a first end adapted to be gripped by a user, a pivot joint located intermediate the first end and a second end of the pole and connecting the pole to the frame member, the pivot joint permitting the oar to pivot about an axis of rotation approximately perpendicular to the pole; and a surface providing resistance to motion of the oar in the liquid, the surface extending substantially between the pivot joint and the second end of the pole.

40. The exercise device of claim 39 further comprising belt means adapted to be submerged in the liquid and mounted on the weight bearing member for moving in sliding contact with the upper surface of the weight bearing member in response to forces generated by the user in the liquid, the belt means comprising an endless, looped belt having a mesh construction for reducing friction between the belt means and the upper surface of the weight bearing member, thereby permitting the user to move the belt means with less effort.

41. The exercise device of claim 39 wherein the pivot joint further comprises:

a first plastic collar extending in a generally horizontal direction from the frame structure;

a second plastic collar extending in a generally horizontal direction outwardly from the straight pole; and a shaft having a low coefficient of friction in the liquid with one of the first and the second plastic collars, the shaft having one end sized to be slidably and rotatably mounted within the one of the first and the second plastic collars, and the shaft having an opposite end sized to fit in the other of the first and the second plastic collars; and a clamp extending between the first and the second plastic collars for holding the first and the second plastic collars on the shaft.

42. An exercise device utilizing a resistance of a liquid comprising:

a weight bearing member having an upper surface adapted to be submerged in the liquid;

a pair of sliding members adapted to be submerged in the liquid and having top and bottom opposed surfaces, the top surface of each of the sliding members being adapted to receive a foot of a user;

mesh means adapted to be submerged in the liquid and located between the bottom surfaces of the pair of sliding members and the upper surface of the weight bearing member, the pair of sliding members moving in a sliding relationship with respect to the upper surface of the weight bearing member in response to forces generated by a user in the liquid, the mesh means comprising a material having a mesh construction for reducing friction between the bottom surface of the pair of sliding members and the upper surface of the weight bearing member, thereby permitting the user to move the pair of sliding members with less effort.

43. The exercise device of claim 42 wherein the weight bearing member includes side rails extending above the upper surface and the pair of sliding members have a combined width extending generally perpendicularly across the upper surface between the pair of side rails.

44. The exercise device of claim 42 wherein the mesh means is a single loop belt mounted on the weight bearing member.

45. The exercise device of claim 42 wherein the mesh means is two looped belts mounted on the weight bearing member for independent motion with respect to each other.

46. The exercise device of claim 42 wherein the mesh means is fixed on the upper surface of the weight bearing member.

47. The exercise device of claim 42 wherein the mesh means is fixed to the bottom surfaces of the pair of sliding members.

48. The exercise device of claim 42 wherein the pair of sliding members is a pair of skis.

49. The exercise device of claim 42 wherein each of the pair of sliding members has at least one resistance element with a surface oriented generally perpendicularly to the direction of motion of the sliding members and providing a resistance to motion of the respective one of the pair of sliding members through the liquid.

50. An exercise device utilizing a resistance of a liquid comprising:

a weight bearing member having an upper surface adapted to be submerged in the liquid;

a pair of side members adapted to be submerged in the liquid and connected to two parallel longitudinal edges of the weight bearing member, the pair of side members having opposed inner directed surfaces extending a predetermined distance above the upper surface;

a pair of sliding members adapted to be submerged in the liquid and having top and bottom opposed surfaces, the top surface of each of the sliding members being adapted to receive a foot of a user and the bottom surface contacting the upper surface in a sliding reciprocating motion there With, the pair of sliding members having longitudinal, outer directed edges immediately adjacent to the inner directed surfaces of the pair of side members and opposed longitudinal, inner edges immediately adjacent each other to cause the pair of sliding members to automatically track and maintain a desired direction of motion in response to relative reciprocating motion with respect to each other.

* * * * *